US008581137B2

(12) United States Patent
Egenter

(10) Patent No.: US 8,581,137 B2
(45) Date of Patent: Nov. 12, 2013

(54) METHOD FOR OPERATING A HEATING DEVICE OF AN ELECTRIC HEATING APPLIANCE HAVING A PLURALITY OF HEATING DEVICES

(75) Inventor: Christian Egenter, Bretten (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 1014 days.

(21) Appl. No.: 12/020,039

(22) Filed: Jan. 25, 2008

(65) Prior Publication Data

US 2008/0210681 A1 Sep. 4, 2008

Related U.S. Application Data

(63) Continuation of application No. PCT/EP2006/007319, filed on Jul. 25, 2006.

(30) Foreign Application Priority Data

Jul. 25, 2005 (DE) ..... 10 2005 035 543

(51) Int. Cl.
*H05B 3/68* (2006.01)

(52) U.S. Cl.
USPC ..... 219/100; 219/448.12; 219/462.1

(58) Field of Classification Search
USPC ..... 219/445.1, 446.1, 447.1, 448.11, 219/448.12, 448.13, 448.14, 460.1, 461.1, 219/462.1
IPC ..... B23K 13/08
See application file for complete search history.

(56) References Cited

U.S. PATENT DOCUMENTS

| | | | | |
|---|---|---|---|---|
| 4,345,145 | A * | 8/1982 | Norwood | 219/492 |
| 4,717,810 | A * | 1/1988 | Schreder | 219/461.1 |
| 5,717,189 | A * | 2/1998 | Goetz et al. | 219/483 |
| 5,981,916 | A * | 11/1999 | Griffiths et al. | 219/492 |
| 6,198,080 | B1 * | 3/2001 | Rice et al. | 219/506 |
| 6,664,519 | B2 | 12/2003 | Hammelsbacher et al. | |
| 6,700,101 | B2 * | 3/2004 | Decesari et al. | 219/485 |

(Continued)

FOREIGN PATENT DOCUMENTS

| | | |
|---|---|---|
| DE | 10123640 | 1/2003 |
| DE | 202004017133 U | 2/2005 |
| EP | 1344983 | 9/2003 |
| GB | 2323436 A * | 2/1998 |

OTHER PUBLICATIONS

International Search Report from PCT/EP2006/007319 dated Dec. 5, 2006.

(Continued)

*Primary Examiner* — Sang Paik
(74) *Attorney, Agent, or Firm* — Alston & Bird LLP

(57) ABSTRACT

In an operating method for a hob having a plurality of heating elements, an operating action for a heating element, such as heating with an additional region on the cooktop or invoking a parboiling step, is selected in an initial step by providing input to a general input sensor element that is not associated with any specific heating element. In a subsequent step, the selected operating action is allocated or associated with a specific heating element by operating a cooking element specific sensor element, for example when setting the power level for that heating element. Therefore, sensor elements can be provided with an advantageous multiple-use effect for general operating actions. Furthermore, the operating sequence permits simple and convenient operation.

15 Claims, 1 Drawing Sheet

(56) References Cited

U.S. PATENT DOCUMENTS

| | | | | |
|---|---|---|---|---|
| 6,734,377 | B2 * | 5/2004 | Gremm et al. | 200/5 R |
| 6,831,254 | B2 * | 12/2004 | Barritt | 219/394 |
| 6,841,760 | B2 * | 1/2005 | Whipple, Jr. | 219/395 |
| 6,924,465 | B2 * | 8/2005 | Schilling et al. | 219/445.1 |
| 6,995,343 | B2 * | 2/2006 | Steiner et al. | 219/448.11 |
| 7,022,949 | B2 * | 4/2006 | Shukla | 219/483 |
| 7,126,088 | B2 * | 10/2006 | Horton et al. | 219/412 |
| 7,186,955 | B2 * | 3/2007 | Fisher et al. | 219/486 |
| 7,304,270 | B2 * | 12/2007 | Fisher | 219/398 |
| 7,368,686 | B2 * | 5/2008 | Etheredge et al. | 219/412 |
| 7,461,588 | B2 * | 12/2008 | Head | 99/326 |
| 2002/0113062 | A1 * | 8/2002 | Cranford | 219/518 |
| 2004/0256378 | A1 | 12/2004 | Shukla | |
| 2007/0125363 | A1 * | 6/2007 | Gassler | 126/273 R |
| 2009/0173730 | A1 * | 7/2009 | Baier et al. | 219/446.1 |

OTHER PUBLICATIONS

German Search Report from German Application No. 10 2005 035 543.9.

First Office Action, dated Apr. 1, 2010, Chinese parallel application 200680027226, Jul. 25, 2006, State Intellectual Property Office, P.R. China.

* cited by examiner

METHOD FOR OPERATING A HEATING DEVICE OF AN ELECTRIC HEATING APPLIANCE HAVING A PLURALITY OF HEATING DEVICES

CROSS REFERENCE TO RELATED APPLICATIONS

This application is a continuation of PCT/EP2006/007319, filed Jul. 25, 2006, which in turn claims priority to DE 10 2005 035 543.9, filed on Jul. 25, 2005.

FIELD OF THE INVENTION

The invention relates to a method for operating one of many heating devices of an electric heating appliance, particularly a hob, which has a plurality of heating devices.

BACKGROUND OF THE INVENTION

Normally, putting into operation an electric heating appliance, such as disclosed in U.S. Pat. No. 6,734,377, takes place by first switching on the complete appliance. For operating purposes, the operating elements are so-to-speak used as switches. This is followed by the selection of a hotplate to be put into operation either by actuating a specific selection switch, or actuating a so-called "plus or minus" switch (which increase or decrease the power levels) specifically provided for said hotplate. The hotplate is then operated with the power level set.

The problem addressed by the present invention is to provide an alternative to an otherwise conventional operating method, which can be performed equally easily and instinctively.

SUMMARY

This problem is solved in one embodiment by a method having the features as claimed herein. Advantageous and preferred developments of the invention form the subject matter of the further claims and are explained in greater detail hereinafter. By express reference the wording of the claims is made into part of the content of the description.

According to the invention, in an initial step of the operating method, which can be implemented with several of the heating devices, a specific operating action is selected or indicated generally by actuating a corresponding operating element (input device). At this time, the operation action is not yet associated to be performed by any indicated heating element. In a subsequent step, a different or second operating element is actuated and the operation action is then allocated or associated with a specific heating device, or actuation of the second operating element takes place in such a way that the allocation to the heating device is precisely preset. As a result of the subsequent actuations, the allocation or association takes place and the taking over or performance of the operating action in question is implemented with by the indicated heating device.

Putting it simply, the invention makes it possible to select an operating action to be carried out first and then allocate a specific, desired heating device to perform the operation action. Thus, the hitherto conventional operating method is reversed as regards to its order, which selects the heating device and then indicates the function to perform. In particular, this new method is suitable for an operating action such as surface characterization, particularly operation with an additional heating range in the form of a so-called multicircuit, or parboiling stage. Therefore, these functions do not require several operating elements (input device), but instead a single element or input device per function. In certain circumstances, it is even possible to provide a single operating element for special functions of the indicated type with which, advantageously in a cyclic manner, it is possible to switch through different special functions.

Apart from the provision of an alternative to known methods, one of the other advantages of this inventive method is that in certain circumstances, it is instinctively easier for an operator to perform this sequence or order. There are also additional design possibilities, for example, in that in this way there can be a complicated selection of an operating action after which the specific heating device is then identified to carry out the indicated operation action.

After switching on the electric heating appliance, the next step can be performed. When the appliance is switched on, it can be the first step of an operating method.

It is possible for the two indicated steps to directly follow one another, i.e., no intermediate step has to be carried out. This facilitates instinctive operation, because the desired operating action is firstly selected and then the action is allocated to, or associated with, a specific heating device.

Advantageously, the second operating element for identifying or allocating the function to the heating device is an operating element for setting the power level for a particular heating device. This operation element can in the form of, for example, a "plus or minus switch" for increasing or decreasing the power on the heating device. On setting the power level for the said heating device, it is particularly advantageous to take over the previously selected operating action for this heating device. This is particularly advantageous if there is in any instance the selection of a heating device via the actuation of one of the switches for power setting purposes.

If a specific time period has elapsed following the selection of the operating action without subsequent allocation of said operating action to a specific heating device, said selection can be cancelled out again or the operating state can be reset to zero. Such a time period can for example be five to ten seconds. This makes it possible to avoid wrong manipulations or an incorrect or undesired allocation of a selected operating action to a heating device.

A cancellation or ending of an operating action can take place in such a way that in a preceding step, the operating action to be ended is selected by actuating a corresponding operating element (e.g., input switch). In a following step, through a further actuation of an operating element allocated to the heating device operated with the operating action, said operating action for said heating device is ended. Thus, in roughly the same method the operating action can be cancelled out again.

It is possible for an operating action to be selected and then to remain selected (so-to-speak) as a set point for a specific time period. This selected operating action can then be allocated to precisely one heating device in precisely this form. With the allocation of a selected operating action to one heating device, said operating action is cancelled again for the other heating devices. For further heating devices to be put into operation, a new operating action must be selected again from the outset in the same way.

Such an operating action can for example provide for the selection of a heating type and a desired power level in two successive operating steps. Much as described hereinbefore, it is possible to proceed in such a way that following the first step within the operating action, a subsequent step must occur within a given time period. If the subsequent step does not take place, or the time period for performing it is exceeded without inputting said further step, the first selected step is cancelled.

These and further features can be gathered from the description and drawings and individual features, both singly or in the form of subcombinations. These features can be implemented in an embodiment of the invention and in other fields, and can represent advantageous, independently protectable constructions for which protection is claimed here. The subdivision of the application into individual sections and subheadings in no way restricts the general validity of the statements made thereunder.

BRIEF DESCRIPTION OF THE DRAWINGS

An embodiment of the invention is described hereinafter relative to the attached diagrammatic drawings, wherein show.

DETAILED DESCRIPTION

Figure 1:
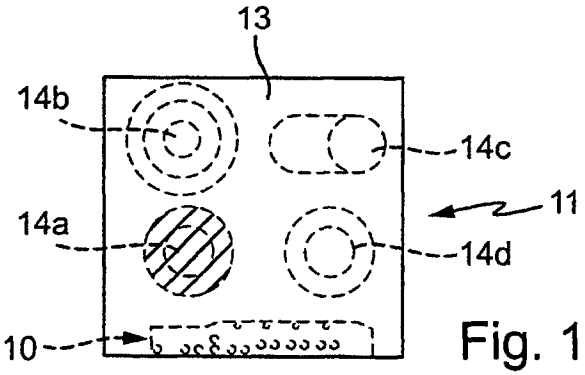
FIG. 1 illustrates a plan view of a hob with an operating device.

Turning now to the figures, FIG. 1 shows a hob 11, which in a known manner has four hotplates 14*a-d* on a hob plate 13 and in the front area an operating device 10. All the hotplates 14*a-d* are constructed as so-called multicircuit hotplates with a basic heating zone and an additional heating zone, as is also known to the expert.

Figure 2:
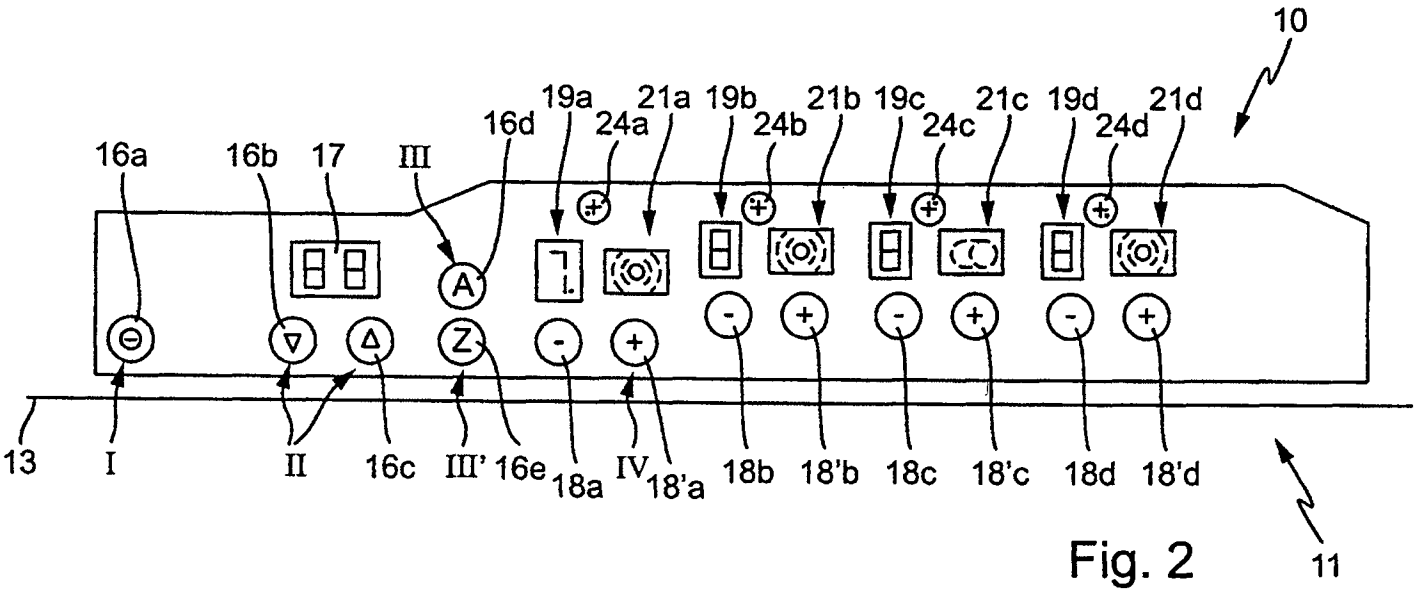
FIG. 2 illustrates a larger scale representation of the operating device according to FIG. 1 with an exemplified sequence during hob operation.

In the larger scale representation of operating device 10 in FIG. 2, it can be seen that the device has several sensor elements in the form of operating elements or touch contact switches or other types of input switches, as well as several displays. First, there are so-called general sensor elements 16 in the form of an on-off switch 16*a*, and two sensor elements 16*b*, 16*c* for the user to indicate a timer function. There is also a sensor element 16*d* for a parboiling surge and a sensor element 16*e* for the connection of additional heating zones with respect to the multicircuit hotplates. Between the sensor elements 16*b* and 16*c* there is a general display 17, such as in the form of a seven-segment display for the timer function.

The other sensor elements 18 shown are intended for specific, individual, hotplate-dependent functions. Namely, there are four pairs of juxtaposed sensor elements. The furthest left pair of sensor elements 18*a*, 18'*a* is used for function selection for the front, left-hand hotplate 14*a* and for setting the power level. The sensor element 18*a* and 18'*a* are in the form of "plus and minus" switches. If one of said sensor elements 18 is actuated, then simultaneously the intended hotplate is selected, advantageously following the first actuation of a sensor element without power level or operation start. Corresponding to the pair of sensor elements 18*a*, 18'*a* there are further pairs of sensor elements 18*b*, 18'*b* to 18*d* and 18'*d*. These are used for operating the respective hotplates 14 specified by the hotplate-specific symbol 24 behind them.

In each case, behind the sensor elements 18*a*, 18'*a* to 18*d*, 18'*d* are provided the associated hotplate-specific displays 19*a* to 19*d* and the hotplate-specific multicircuit displays 21*a* to 21*d*.

By actuating one of the sensor elements 18, it is possible to allocate the previously selected operating action to one of the hotplates 14 and a power level setting. Thus, only the absolutely necessary number of sensor elements are provided to accomplish the functions of the timer, parboiling surge and additional heating functions. They can be used in a simple manner for setting each appropriate hotplate. In addition, the novel order of operation permits simple, comfortable operation.

It is obvious that within the scope of the invention more or less sensor elements could be provided, as could more or less hotplates 14. In place of touch contact switches with sensor elements, it can also be possible to use other operating elements, such as piezoelectric sensors or mechanical contact switches. The displays can also be differently constructed, for example implemented in simple manner by LEDs or in more complicated manner by a screen using other technologies.

Function

The order of an exemplified operating method is described by the steps characterized with Roman numerals.

In step I the hob 11 is switched on by actuating sensor element 16*a* in the operating device 10. The hob 11 is now ready to operate in a basic state.

It is possible, following step II, to activate and set a timer function by actuating several times the sensor element 16*b* or 16*c*. Alternatively, it is possible following step I (with or without step II) to activate and set a parboiling surge by using sensor element 16*d* (which is step III). The latter is used for operating the hotplate 14 to be subsequently selected. Furthermore, in addition to, or in lieu of step III, a step III' can exist in which sensor element 16*e* can be selected for operating an additional heating zone for a multicircuit or two-circuit operation in conjunction with a subsequently selected hotplate 14.

For the additional heating zone, it is possible to provide that the hotplates 14 are either put into operation in the basic state with the additional heating zone or without an additional heating zone. Consequently, as a function of the desired state, the additional heating zone is either disconnected or connected. Thus, through steps I to III, the hob 11 is switched on and optionally, input is provided for an indicated function, such as a timer, parboiling surge, or the additional heating zone for multicircuit operation. This specified operating action only has to be allocated to a hotplate. Moreover, the hotplate's power level must be set.

For this purpose, in a following or final step IV, sensor element 18'*a* may be actuated. Following the first actuation, hotplate 14*a* is selected for a following power setting. The previously selected operating mode is automatically allocated to this hotplate. Through further actuation of sensor element 18'*a*, the power level of the indicated hotplate or heating element is increased in steps, for example, up to seven actuations, which represents a stage 7 power level. In all, the sensor element 18'*a* is actuated eight times.

Thus, the previously selected operating action is allocated to the left, front, hotplate 14 and it starts functioning corresponding to the given operating action. This can be seen with respect to the state of hotplate 14*a* in FIG. 1, indicated by hatched lines where hotplate 14*a* and additional heating zone are in operation. Thus, step III' has been carried out here. By means of the display 19*a* above sensor element 18*a*, it is shown to the user that the hotplate is operated with power stage 7. A change to the power level during the operation of hotplate 14*a* can normally take place via sensor elements 18*a* or 18'*a*.

Alternatively to a power selection starting at zero and incremented in steps, on a second actuation of sensor element 18'*a*, there can be a direct, single-step increase of the power to the highest power stage. Similarly, on actuating the sensor element 18*a* for power reduction, there can be a direct jump or single step decrease to a medium power stage. However, independently thereof, through the first actuation of one of the sensor elements 18*a* or 18'*a*, the previously selected operating mode is automatically allocated to the desired hotplate.

Correspondingly, it is possible to again select an aforementioned operating action in steps II, III or III', and allocate the indicated function to the hotplate 14*c* through the actuation of sensor element 18*c* or 18'*c*. Hotplate 14*c* would then be operated with the selected operating action. Alternatively, it is possible through a single actuation of sensor element 16*d* and/or 16*e* for the functions of the parboiling surge and additional heating to remain permanently selected for the subsequently indicated hotplates. This can be displayed by a corresponding illuminated display. The functions must be expressly deselected if they are not desired for a hotplate.

The invention claimed is:

1. A method for operating one of a plurality of hotplate heating elements of an electric heating appliance comprising a hob comprising the steps of:

selecting an operating action by actuating a first input device wherein said operating action is performable by any one of said plurality of hotplate heating elements, wherein further said operating action is not associated with any one of said plurality of hotplate heating elements; and allocating one of said plurality of hotplate heating elements for performing said specific operating action by actuating a second input device specifically associated with one of said plurality of hotplate heating elements.

2. The method according to claim 1, wherein said step of allocating one of said plurality of hotplate heating elements for performing said specific operating action by actuating a second input device specifically associated with one of said plurality of hotplate heating elements follows directly after said selecting said operating action.

3. The method according to claim 1, wherein said second input device associated with said one of said plurality of hotplate heating elements is a different input device for setting a power level, and in response to setting said power level for said one of said plurality of hotplate heating elements said selected operating action is performed by said hotplate heating elements.

4. The method according to claim 1, wherein said actuating said second input device for allocating for performing said specific operating action for one of said plurality of hotplate heating elements occurs within a specific time period following said step of selecting said operating action, otherwise selection of said operating action is cancelled.

5. The method according to claim 4, wherein said specific time period is 5 to 10 seconds after said selecting said operating action.

6. The method according to claim 1, further comprising the steps of:

selecting a second operating action, wherein said second operating action cancels said operating action; and selecting an allocated hotplate heating element for performing the second operating action, whereby the second operating action cancels said operation action performed by said hotplate heating element.

7. The method according to claim 1, wherein selection of said operating action is defined as operating a specific time period for a subsequently allocated hotplate heating element, and following an allocation to said one of a plurality of hotplate heating elements said selection of said operating action ceases for a remaining hotplate heating element.

8. The method according to claim 7, wherein following said allocation to said hotplate heating element, a second operating action selection occurs by actuating said input device for a further allocation thereof to a different hotplate heating element.

9. The method according to claim 1, wherein said operating action comprises heating an additional range of a surface heating for said one of said plurality of hotplate heating elements or selecting a parboiling stage for said one of said plurality of hotplate heating elements.

10. The method according to claim 9, wherein following said selecting said operating action for a specific time period, a further operating action is indicated, and on exceeding said power level all settings hitherto carried out in said selection process are cancelled.

11. A method for operating a selected heating element of an electric heating appliance comprising a hob, further comprising a plurality of hotplate heating elements, wherein each one of said plurality of hotplate heating elements is capable of performing an indicated operating action, said heating appliance having a control panel comprising a plurality of operating input devices, comprising the steps of:

receiving an initial input by said user at a first operating input device of said control panel, said initial input indicating said operating action that is performable by any one of said plurality of hotplate heating elements, wherein said initial operating action by itself is not associated for potentially being performed by any one of said plurality of hotplate heating elements; and receiving a subsequent input relative to the initial input at a second operating input device of said control panel identifying said selected hotplate heating element for performing said operating action thereby causing said selected hotplate heating element to operate at an indicated power level.

12. The method of claim 11 wherein said receiving said subsequent input is received within 10 seconds after said initial input is provided.

13. The method of claim 11 wherein the initial operating action is a timer function indicating a time duration for which power is to be applied to said selected hotplate heating element.

14. The method of claim 11 further comprising:

receiving a third input at the second operating input device of said control panel wherein said third input causes said selected hotplate heating element to cease operation.

15. The method of claim 11 wherein said subsequent input at said second input device determines a power level setting for said selected hotplate heating element.

* * * * *